US005431036A

United States Patent [19]

Bogart

[11] Patent Number: 5,431,036

[45] Date of Patent: Jul. 11, 1995

[54] NEEDLE CURVING APPARATUS

[75] Inventor: Michael W. Bogart, Bridgeport, Conn.

[73] Assignee: United States Surgical Corporation, Norwalk, Conn.

[21] Appl. No.: 135,279

[22] Filed: Oct. 12, 1993

Related U.S. Application Data

[63] Continuation of Ser. No. 939,124, Sep. 2, 1992, abandoned.

[51] Int. Cl.[6] ..... B21G 1/00

[52] U.S. Cl. ..... 72/171; 163/1

[58] Field of Search ..... 72/133, 170, 171, 172, 72/166, 369, 702; 163/1, 5

[56] References Cited

U.S. PATENT DOCUMENTS

| | | | |
|---|---|---|---|
| 1,427,101 | 8/1922 | Gilbert | 72/167 |
| 1,590,491 | 6/1926 | Beall | 72/175 |
| 1,666,909 | 4/1928 | Philippi | 72/175 |
| 1,676,173 | 7/1928 | Wermes . | |
| 1,688,099 | 10/1928 | Wagenbach | 72/175 |
| 1,697,896 | 1/1929 | Yates | 72/167 |
| 1,702,856 | 2/1929 | Trosch | 72/175 |
| 2,093,933 | 9/1937 | Sinclair . | |
| 2,309,963 | 2/1943 | Krueger | 72/133 |
| 2,353,925 | 7/1944 | Pattison | 72/166 |
| 2,457,705 | 12/1948 | Moran | 72/166 |
| 2,579,858 | 12/1951 | Price . | |
| 2,647,743 | 8/1953 | Cook | 72/166 |
| 2,722,261 | 11/1955 | Bishop | 72/170 |
| 2,739,763 | 3/1956 | Silfverlin et al. | 72/170 |
| 2,937,821 | 5/1960 | O'Brien | 72/171 |
| 2,990,001 | 6/1961 | Hansen | 72/166 |
| 3,038,475 | 6/1962 | Orcutt . | |
| 3,040,798 | 6/1962 | Johnson | 72/172 |
| 3,064,711 | 11/1962 | Fuchs, Jr. | 72/166 |
| 3,279,229 | 10/1966 | Lagher | 72/170 |
| 3,326,025 | 6/1967 | Nishioka | 72/166 |
| 3,444,716 | 5/1969 | Martin | 72/166 |
| 3,456,321 | 7/1969 | Furt et al. | 72/199 |
| 3,608,347 | 9/1971 | Kemminer | 72/166 |
| 3,704,616 | 12/1972 | Taira | 72/167 |
| 3,808,863 | 5/1974 | Marcovitch | 72/199 |
| 3,937,052 | 2/1976 | Hoexter et al. | 72/166 |
| 3,994,656 | 11/1976 | Van Ausdall | 72/170 |
| 4,040,283 | 8/1977 | Suriano | 72/175 |
| 4,063,442 | 12/1977 | Martin, Sr. | 72/166 |
| 4,145,904 | 3/1979 | Giros et al. | 72/142 |
| 4,312,208 | 1/1982 | Schafer | 72/166 |
| 4,346,577 | 8/1982 | Peters et al. | 72/129 |
| 4,524,771 | 1/1985 | McGregor et al. | 128/339 |
| 4,633,698 | 1/1987 | Oetiker | 72/166 |
| 4,702,097 | 10/1987 | Zahlaus | 72/702 |
| 4,777,816 | 10/1988 | Inoue | 72/166 |
| 5,041,127 | 8/1991 | Troutman . | |

FOREIGN PATENT DOCUMENTS

| | | | |
|---|---|---|---|
| 2385462 | 10/1978 | France . | |
| 3443851 | 6/1986 | Germany . | |
| 63-73989 | 4/1988 | Japan . | |
| 63-309338 | 12/1988 | Japan . | |
| 3118050 | 5/1991 | Japan . | |
| 0054818 | 6/1943 | Netherlands | 72/166 |
| 2168277 | 6/1986 | United Kingdom . | |

OTHER PUBLICATIONS

European Search Report; Jan. 19, 1994.

Abstract of JP-A-61 009927; Jan. 17, 1986.

*Primary Examiner*—Lowell A. Larson

*Assistant Examiner*—Thomas C. Schoeffler

[57] ABSTRACT

An apparatus for curving a needle is provided which comprises at least two generally cylindrical members rotatably connected to a frame. At least one anvil shaft is positioned substantially between the cylindrical members and is rotatably connected to the frame. A needle is positionable between the anvil shaft and the cylindrical members such that the needle is curvable about the anvil shaft. A driving assembly rotates the cylindrical members and the anvil shaft such that the needle is curved about the anvil shaft and expelled from the apparatus.

29 Claims, 4 Drawing Sheets

NEEDLE CURVING APPARATUS

This is a continuation of application Ser. No. 07/939,124 filed on Sep. 2, 1992, now abandoned.

BACKGROUND OF THE INVENTION

1. Field of the Invention

The present invention relates to needle curving devices and, more particularly, to surgical needle curving devices for curving one or more needles simultaneously.

2. Description of the Related Art

Surgical needle manufacture is an extremely precise and time consuming process, particularly where individual needles are formed one at a time. Conventional surgical needle manufacturing typically begins with the step of cutting round wire stock to a predetermined length. One end of the stock is then tapered to provide a cutting edge while the opposite end may be manipulated or processed to attain a flattened or other predetermined shape. Later, typically after almost all of the processing is completed, the stock is cut to its final length and then prepared for suture attachment. The needle may then be subjected to further processing, i.e., further refinement such as grinding, polishing and/or hardening.

Curved needles have advantages over other needle configurations in many surgical procedures for a variety of reasons including, uniformity of entry depth for multiple sutures, and proper "bite" of tissue surrounding the incision or wound. When providing curved needles for surgical procedures it is desirable for the needles to have a specified curvature, i.e., a predetermined radius of curvature. The predetermined radius of curvature for the needle may vary with specific applications.

Configuration of a needle includes curving or forming the needle into predetermined shapes and may be accomplished by using conventional curving methods. Such conventional curving methods may include bending a needle around an anvil structure having a desired curving surface to curve a needle to a predetermined radius of curvature.

Where a curved needle is to have a bore for receiving a suture, it is desirable for the curving procedure to precede boring the needle so that the hole is not deformed by the curving procedure.

To attain the desired needle configuration, the anvil structure provides a shaping surface for deforming the needle. Typically, a needle is positioned for curving by manually placing the needle for engagement with an anvil structure. The needle may be held by hand or placed in a holding device which is manipulated manually.

It is further known that because needles are made of steel or similar springy materials, the anvil or mandrel used should have a smaller radius than the radius desired in the final needle to allow for some springback after the bending operation. A disclosure of such features may be found in, for example, U.S. Pat. No. 4,534,771 to McGregor et al.

One disadvantage to conventional needle curving is that only one needle can be curved around an anvil structure at a time. Moreover, the needle is positioned for engagement about an anvil surface using manual means. Further, during the needle curving process the needle may be damaged.

It would therefore be desirable to provide a needle curving device that is capable of simultaneously curving a multiplicity of needles. It would further be desirable to provide a needle curving device to cooperate with a needle holding structure for positioning one or a multiplicity of needles for curving. It would further be desirable for a needle curving device to substantially avert damaging needles. It would also be desirable for a needle curving device to entertain substantially continuous needle curving. It would further be desirable to provide a needle curving device to curve a multiplicity of needles in predetermined configurations.

SUMMARY OF THE INVENTION

A needle curving apparatus is provided for curving one or a multiplicity of needles. The needle curving apparatus includes at least two rotatable members and a rotatable anvil shaft positioned therebetween. The needle curving apparatus further includes a holding member for presenting at least one needle to the rotatable anvil shaft such that the needle is curved substantially about the rotatable anvil. A drive means directly or indirectly rotates the rotatable members providing continuous motion of a needle through the apparatus.

In a particularly useful embodiment of the invention, the holding member of the needle curving apparatus comprises a belt that is routed as a continuous web over the rotatable members and the anvil shaft for holding one or a multiplicity of needles between the rotatable members and the anvil shaft and for urging the needle or needles around the anvil shaft. The belt may be caused to move by the drive means and may frictionally engage and rotate the rotatable members and anvil shaft. The belt is preferably made of an elastomeric material to positively grip the needle and to substantially avert damage to the needle during the curving process.

The needle curving apparatus provided may also be configured and adapted for working in concert with a needle holding structure for positioning a multiplicity of needles for curving.

A plurality of rotatable members may also be provided which are positioned in spaced relation to the anvil shaft for holding and curving a needle around the anvil shaft.

BRIEF DESCRIPTION OF THE DRAWINGS

The foregoing features of the present invention will become more readily apparent and will be understood by referring to the following detailed description of preferred embodiments of the invention, which are described hereinbelow with reference to the drawings wherein.

DETAILED DESCRIPTION OF PREFERRED EMBODIMENTS

Figure 1:
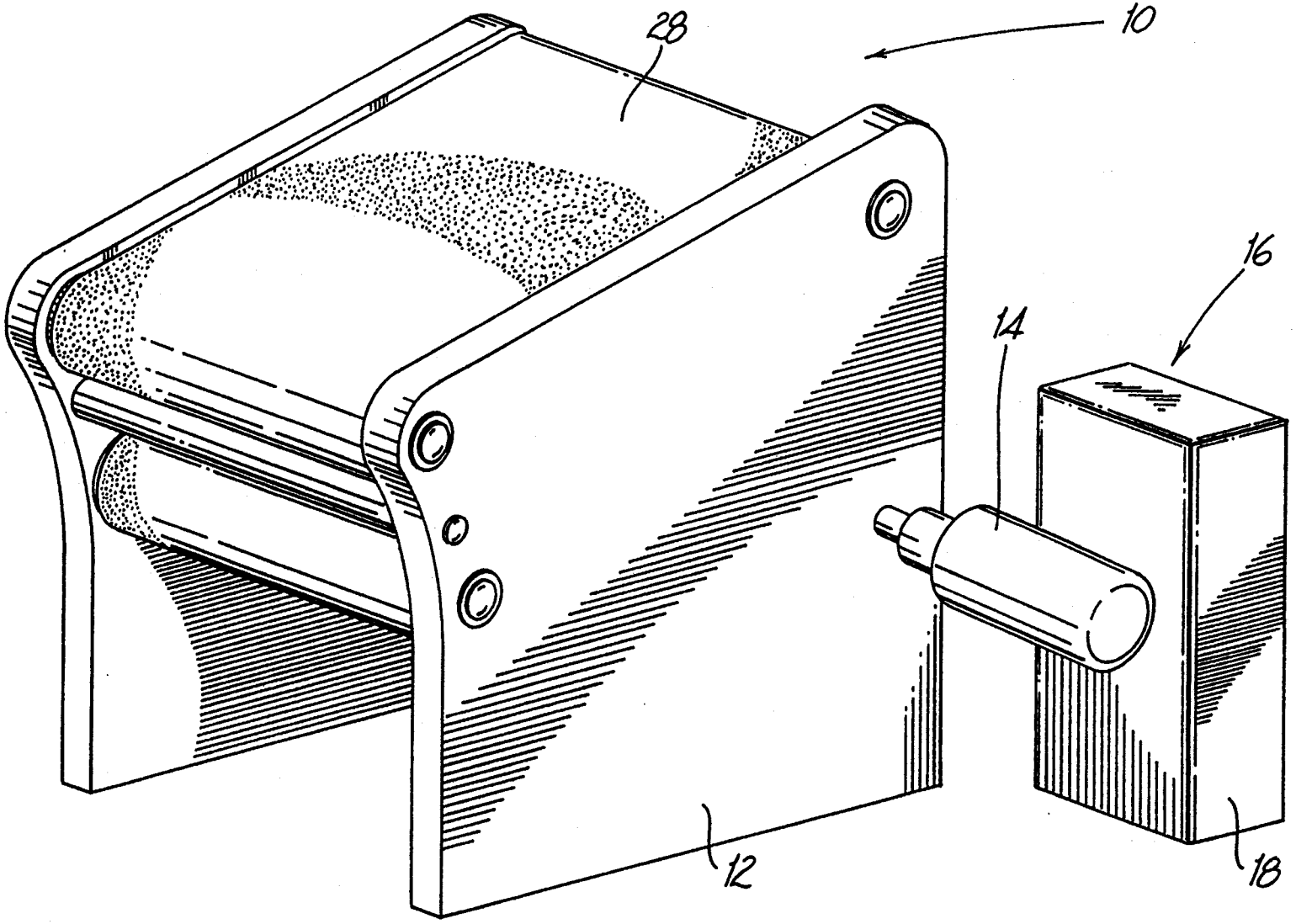
FIG. 1 is a perspective view illustrating a curving apparatus according to one embodiment of the present invention.

Referring to the drawings, in which like reference numerals identify identical or similar elements, FIGS. 1–5 illustrate a preferred embodiment of a curving apparatus 10 in accordance with the present invention. The curving apparatus 10 includes a frame 12 having a rotatably mounted drive shaft 14 in the rear area of the frame 12. A motor assembly 16 rotates the drive shaft 14 at a predetermined speed. Drive shaft 14 respectively engages and rotates a belt 28 as described below. The motor assembly 16 may be of any conventional design having a power output capable of rotating the drive shaft 14 to perform the function described herein.

Rotatable members shown as lower and upper cylinders 20 and 22, are rotatably mounted to frame 12. Conventional bearings (not shown) provide smooth and free rotation of the cylinders 20, 22. The cylindrical members may be solid, partially solid or hollow in cross-section.

An anvil shaft 24 is rotatably mounted to the frame 12 in a position between the upper and lower rotatable cylinders 20, 22, as described below. The anvil shaft 24 is preferably made of a steel or other material having a hardness substantially equivalent to the hardness of the needles being curved. Thus, the anvil may have a Rockwell hardness value between about 55C and about 57C to discourage unwanted shaping or scratching of the needles and/or anvil. The anvil shaft 24 preferably has a solid cross-section.

An idler shaft 26 is rotatably mounted to the frame 12 in a position generally above the horizontal plane of the drive shaft 140. The idler shaft 26 assists in providing stability for rotating belt 28.

Belt 28 is routed in a continuous web over the drive shaft 14, the idler shaft 26, and the upper and lower cylinders 20, 22, as well as the anvil shaft 24. The belt 28 thus forms a closed loop about the rotatable members and is frictionally driven, for example, in a clockwise direction by the drive shaft 14. Belt 28 is preferably composed of material that is flexible enough to wrap about the rotatable members 20 and 22, and strong enough to assist in bending the needle 30 about the anvil 24 without damaging the needle. Such material include elastomeric materials having a durometer value between about 80 and about 90. Suitable materials for the belt include Neoprene.

The belt 28 may be adjusted to enhance the frictional contact between the surface of belt 28 and the anvil shaft 24, drive shaft 14, idler shaft 26 and rotatable members 20 and 22. Idler shaft 26 may be loosened and its position on the frame 12 adjusted to allow adjustment of the tension on belt 28 or to facilitate the substitution of belts of different thicknesses.

Figure 2:
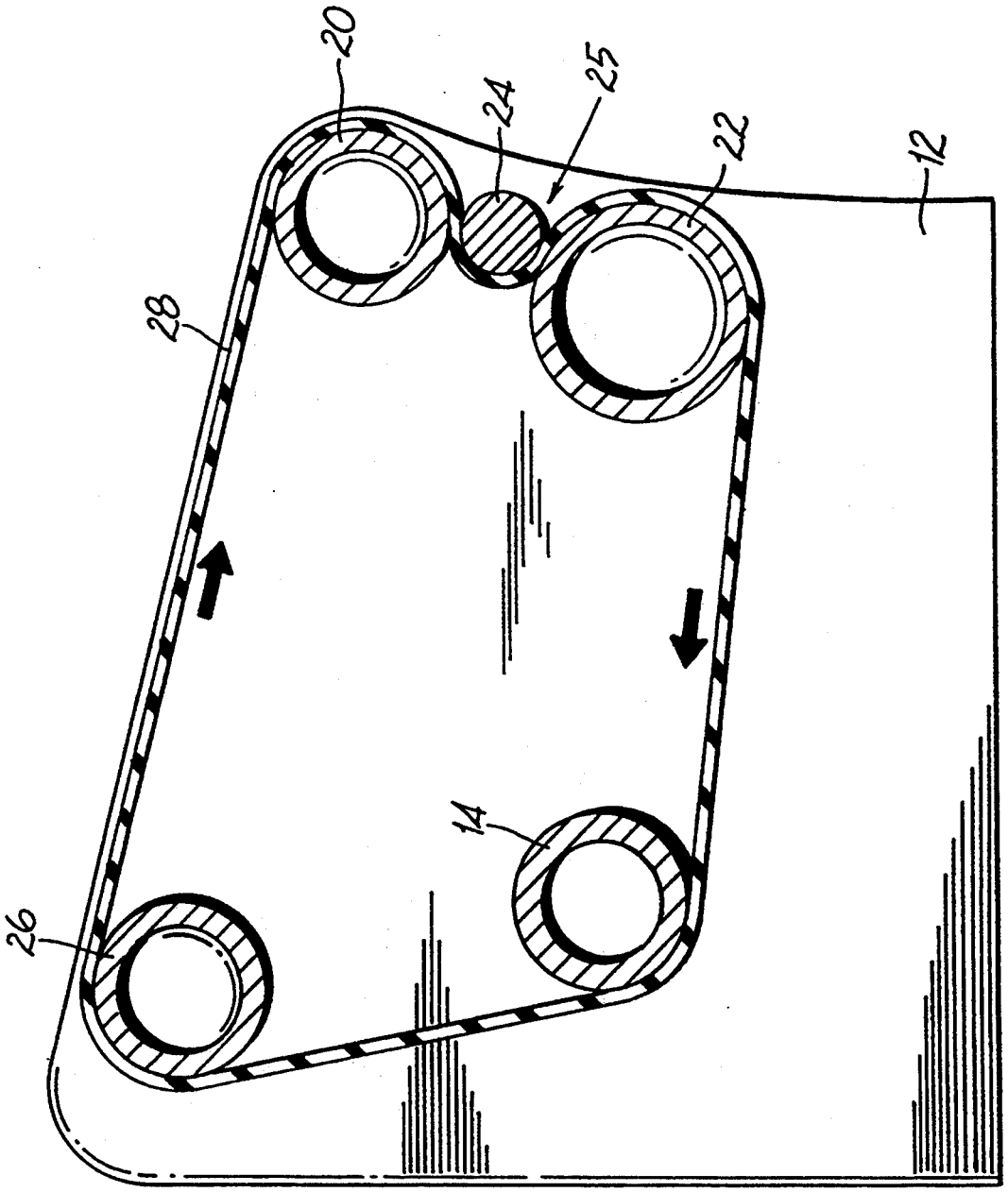
FIG. 2 is a cross-sectional view taken longitudinally through the belt of the apparatus of FIG. 1 illustrating the rotatable members and anvil shaft.

In the embodiment shown, belt 28 is preferably routed about the front portions of upper and lower rotatable cylinders 20, 22 and to the rear of the anvil shaft 24. In cross-section, the belt 28 generally has an "S" shaped configuration, as shown in FIG. 2. This positioning permits the anvil shaft 24 to provide a tensioning effect to the belt 28 and forms a needle curving portion 25 for curving needles. The belt 28 is further positioned about the rear of the idler shaft 26 and the drive shaft 14.

The elastomeric nature of the belt 28 allows the belt 28 to translate the driving force from the drive shaft 14 to rotate cylinders 20, 22. Further, the belt 28 acts as a holding means for positioning needles 30 between the anvil shaft 24 and the upper and lower rotatable cylinders 20, 22. It is envisioned that the belt may have a layered structure, with the outermost layer being of an elastomeric material. Belt 28 may be made from any material capable of the functions described herein.

The anvil shaft 24, rotatable member 20 and belt 28 are configured and dimensioned to form a space 27 at which a needle can be received for curving. For example, a needle 30 can be positioned at a needle curving portion 25 between the anvil shaft 24 and the belt 28. The upper cylinder 20 provides pressure from above on the belt 28. The belt 28 is sufficiently strong to avoid puncturing by the needle 30 during operation. The positioning of the belt 28 about the anvil shaft 24 also provides positive guidance of the needle 30 between the belt 28 and the anvil 24 as it is curved about the anvil shaft 24. The lower rotatable cylinder 22 provides pressure to the belt 28 from below.

As the needle 30 is curved about the anvil shaft 24 and expelled from the apparatus it retains its curved shape. The needle's radius of curvature is determined by the diameter of the anvil 24 as it is curved about the anvil shaft 24 and by the material of construction of the needle. For example, a larger diameter anvil shaft 24 will produce a larger radius of curvature of the needle 30, and a smaller diameter anvil shaft 24 will produce a smaller radius of curvature of the needle 30. Typically, to provide a suitable radius of curvature for surgical needles, the anvil shaft 24 will have a diameter between about 0.200" and about 0.500". Preferably, the anvil shaft is removably mounted on frame 12 such that anvils of different sizes can be readily substituted to accommodate different size needles.

The upper and lower cylinders 20, 22 are positioned in relation to the anvil 24 such that a needle 30 may be curved around the anvil 24 while maintaining sequential contact with the upper and lower cylinders 20, 22. As best seen in the embodiment depicted in FIGS. 1 and 2, the longitudinal axes of cylinders 20, 22 can lie on opposite sides of a vertical plane passing through the longitudinal axis of anvil shaft 24. It is also contemplated that the belt 28, as described above, will hold a needle 30 in place about the anvil 24 independently of the upper and lower cylinders 20, 22.

In some configurations and/or materials of construction a needle may have a certain amount of spring back properties, i.e., the tendency for a structure to return to its original shape after being deformed. In cases such as these, the needle 30 can be curved beyond the desired radius of curvature by a predetermined amount so that it will spring back to a desired radius. Thus, where spring back properties require, it is contemplated by the present invention that a needle 30 may be curved about an anvil shaft 24 having a smaller diameter than the desired final radius of curvature of the needle. Further, it is also contemplated that an anvil 24 may be designed having differently configured cross-sections to appropriately shape a needle 30, for example, an anvil shaft having an elliptical cross-section.

Figure 3:
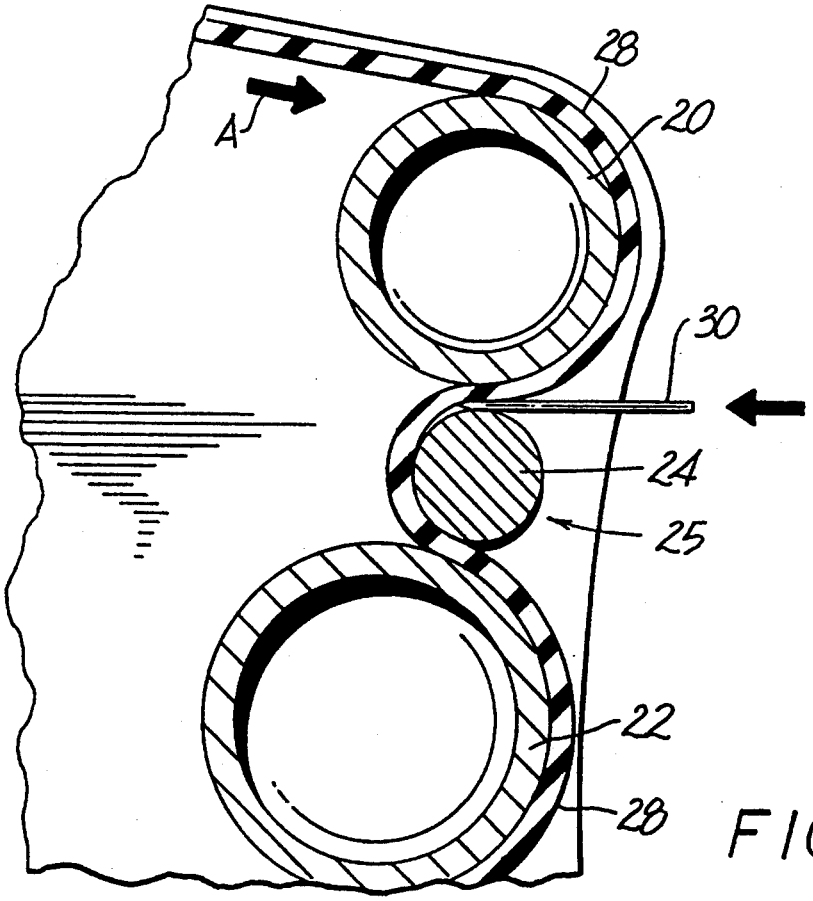
FIGS. 3, 4, and 5 are enlarged cross-sectional views illustrating a curving sequence for a needle using the curving apparatus of FIG. 1.
Figure 4:
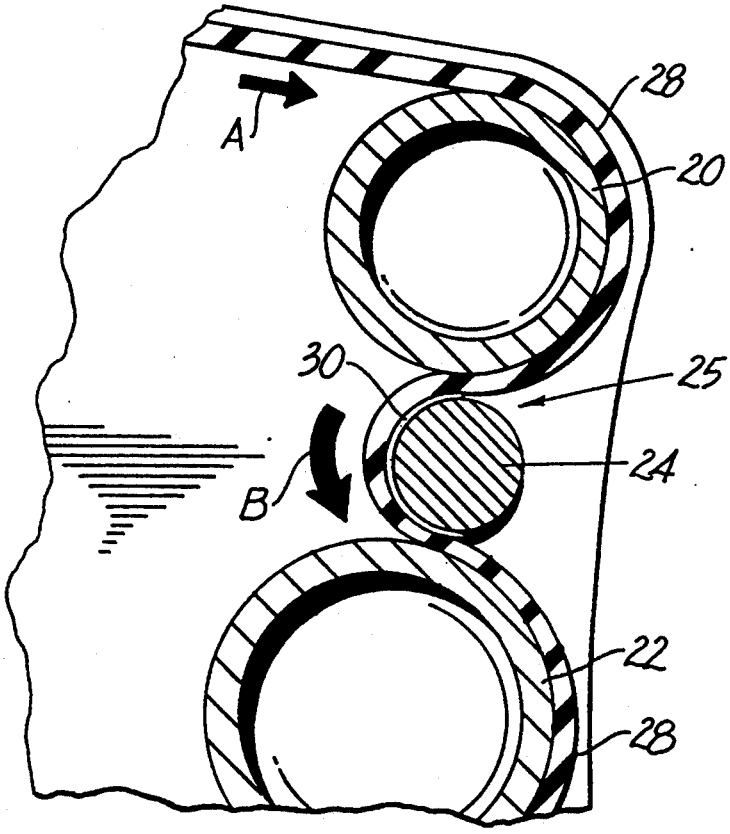
Figure 5:
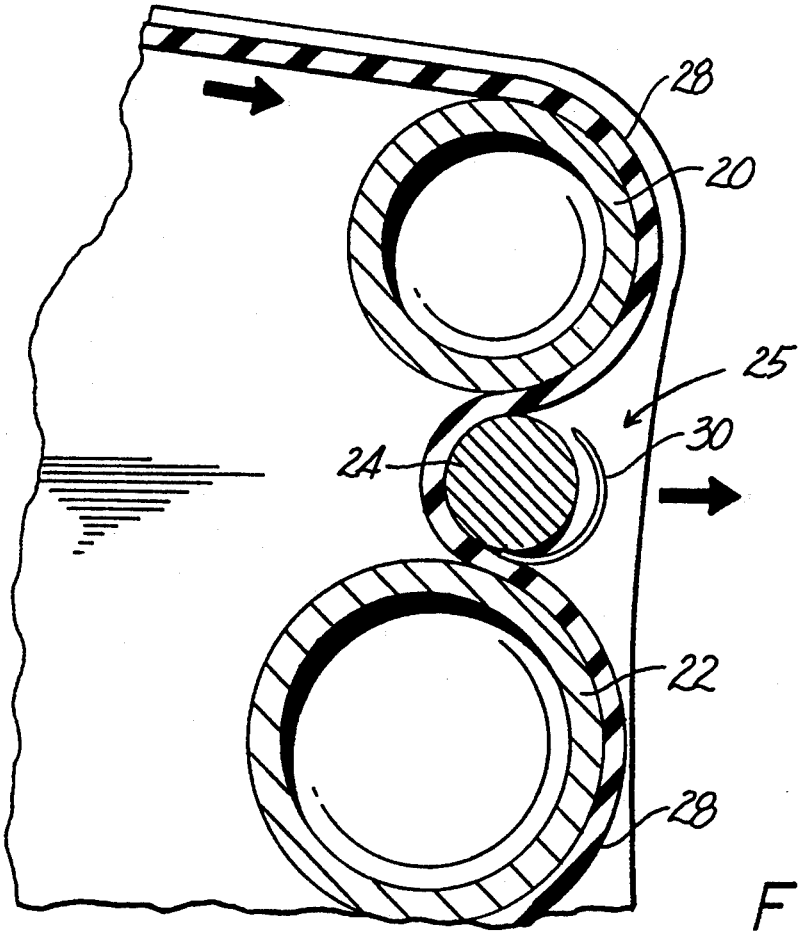

Referring to FIGS. 3–5, in operation a needle 30 is positioned in the needle curving portion 25 adjacent to the upper cylinder 20 between the rotatable anvil 24 and the belt 28. The needle 30 is held in position by the frictional force between the anvil 24 and the belt 28 provided by the upper cylinder 20, and the tension of the closed loop of the belt 28. As belt 28 is driven in the direction of Arrow A, the needle 30 will be drawn in the direction of Arrow B. The needle 30 will initially follow the path of belt 28 and begin to curve around the anvil shaft 24.

As shown in FIG. 4, the needle 30 is held between the belt 28 and the anvil 24 such that the needle 30 travels around the outer surface of anvil shaft 24 and is thereby curved. The needle 30 is held between the belt 28 and the anvil 24 and makes indirect contact with the upper and lower cylinders 20, 22. As the needle 30 is curved around the anvil shaft 24, the distal end of the needle 30 continues to be positioned between the upper cylinder 20 and the anvil 24 while the proximal end of the needle 30 is between the lower cylinder 22 and the anvil 24.

Referring to FIG. 5, the needle 30 continues to travel around the anvil shaft 24 until the distal end is between the lower cylinder 22 and the anvil shaft 24. Thereafter, the needle 30 is expelled from the curving apparatus 10 with a predetermined radius of curvature.

Although the belt 28, driven by drive shaft 14 is coupled to a motor assembly 16, other motor assemblies or driving assemblies are contemplated such as, for example, a chain, or an endless web.

Figure 6:
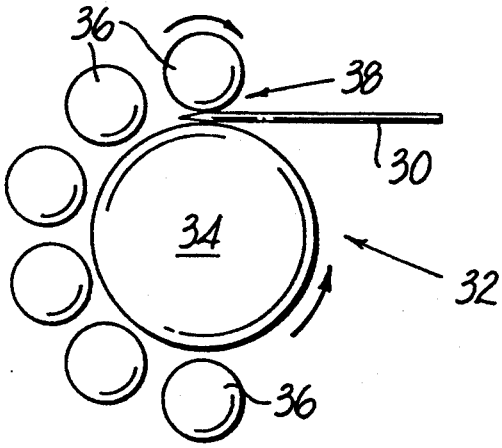
FIGS. 6, and 7 are side elevational views illustrating another embodiment of a needle curving apparatus having a plurality of rotating members and an anvil shaft and showing a curving sequence for a needle.
Figure 7:
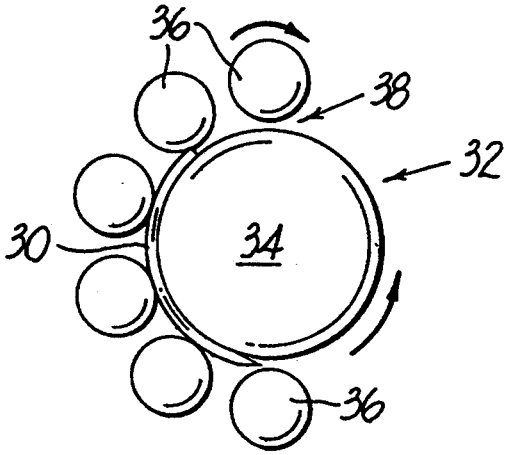

Another embodiment of the curving apparatus 32 is shown in FIGS. 6, and 7. The curving apparatus 32 is similar to the embodiment shown in FIGS. 1–5 in that it includes an anvil shaft 34 rotatably connected to the frame 12. However, in contrast to the embodiment shown in FIGS. 1–5, the belt is eliminated and a plurality of rotatable elements 36 are used to form a needle 30 around the anvil shaft 34.

The anvil shaft 34 is rotatably driven by a motor or similar means and the rotatable elements 36 rotate freely about an axis. The plurality of rotatable elements 36 are positioned circumferencially around and in spaced relation to the anvil shaft 34 such that a needle 30 may be curved around the anvil 34 while maintaining contact with the rotatable elements 36 and the anvil shaft 34 simultaneously.

In operation, a needle 30 is positioned adjacent an upper portion 38 of the anvil shaft 34 which is between the rotatable element 36 and the anvil shaft 34. The needle 30 is held in position between the anvil shaft 34 and the rotatable elements 36. The anvil shaft 34 is driven in a counter clockwise direction such that the frictional force between the anvil shaft 34, the rotatable elements 36, and the needle 30 urges needle 30 to curve around the anvil shaft 34. As the needle 30 is curved around the anvil shaft 34, the entire needle 30 becomes positioned between the anvil shaft 34 and the rotatable elements 36. Finally, the needle 30 is expelled from the curving apparatus 32 with a predetermined radius of curvature.

It is further contemplated that the anvil shaft 34 and the rotatable elements 36 may both be rotatably driven, or the rotatable elements 36 may be driven and the anvil shaft 34 rotate freely.

In accordance with the present invention a multiplicity of needles may be simultaneously curved, particularly when used in cooperation with a needle holding structure. The invention also allows for continuous needle curving without damage to the needle.

While the invention has been particularly shown, and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. An apparatus for curving needles which comprises: means for curving a needle to a predetermined radius of curvature without substantially changing the cross-sectional shape of the needle, said curving means having at least two rotatable members and a rotatable anvil shaft positioned therebetween, said anvil shaft and rotatable members being dimensioned and configured such that a plurality of needles are simultaneously positionable between said anvil shaft and said rotatable members such that said needles are curvable around said anvil shaft, the longitudinal axes of said rotatable members and said anvil shaft being in fixed parallel spatial relation, the longitudinal axes of two of said rotatable members being positioned on opposite sides of a vertical plane passing through the longitudinal axis of said anvil shaft.

2. An apparatus according to claim 1, wherein said rotatable members comprise substantially parallel cylinders.

3. An apparatus according to claim 1, wherein said rotatable anvil shaft comprises a generally cylindrical configuration.

4. An apparatus according to claim 3, wherein said shaft has a diameter between about 0.200" and about 0.500".

5. An apparatus according to claim 1, wherein said rotating means comprises a driving assembly having a drive shaft connected to at least one of said rotatable members or said rotatable anvil shaft.

6. An apparatus according to claim 5, wherein said driving assembly comprises a belt routed around said drive shaft, said rotatable members, and said rotatable anvil shaft.

7. An apparatus according to claim 6, wherein said belt comprises an elastomeric portion.

8. An apparatus according to claim 7, wherein said elastomeric material is selected from the group consisting of Neoprene, Nylon, Polyurethan, and Kevlar.

9. An apparatus according to claim 7, wherein said elastomeric material portion has a durometer value between about 80 and about 90.

10. An apparatus according to claim 6, wherein said rotatable members comprises an elastomeric coating.

11. An apparatus according to claim 6, wherein said rotatable anvil shaft comprises an elastomeric coating.

12. An apparatus according to claim 6 wherein a first rotatable member and said anvil shaft simultaneously contact a first portion of said belt and a second rotatable member and said anvil shaft simultaneous contact a second portion of said belt.

13. An apparatus according to claim 6 wherein a first rotatable member and said anvil shaft are positioned for exerting force on a first end of the needle and a second rotatable member and said anvil shaft are positioned for exerting force on a second end of the needle while a force is being applied to said first end of the needle.

14. An apparatus according to claim 1, wherein said means for rotating comprises a belt for frictionally rotating said rotatable members and said rotatable anvil.

15. An apparatus according to claim 1, wherein said means for holding comprises a belt for frictionally engaging a needle against said rotatable anvil shaft.

16. An apparatus according to claim 15, wherein said belt is routed about said rotatable members and communicates with said rotatable anvil shaft.

17. An apparatus for curving needles which comprises:

a frame;

at least first and second rotatable generally cylindrical members positioned in said frame;

at least one rotatable anvil shaft positioned substantially between said cylindrical members, the longitudinal axes of said cylindrical members and said anvil shaft being in fixed parallel spatial relation, said anvil shaft having a substantially smaller diameter than the diameters of said cylindrical members;

belt means for holding at least one needle against said rotatable anvil shaft such that the needle passes between said anvil shaft and a first cylindrical member and between said anvil shaft and a second cylindrical member such that the needle is curved about said anvil shaft without substantially changing the cross-sectional shape of the needle; and means for driving said cylindrical members and said anvil shaft.

18. An apparatus according to claim 17, wherein said means for holding comprises a belt having a portion formed of an elastomeric material.

19. An apparatus according to claim 17, wherein said means for driving comprises a drive shaft for rotating said cylindrical members and said rotatable anvil shaft.

20. An apparatus according to claim 19, wherein said means for driving comprises a belt having an elastomeric portion which rotatably engages with said cylindrical members and said rotatable anvil shaft.

21. An apparatus for curving needles which comprises:

a frame;

at least two generally cylindrical members rotatably attached to said frame;

an anvil shaft rotatably positioned adjacent to said frame and positioned substantially between said generally cylindrical members, said anvil shaft and generally cylindrical members being dimensioned and configured such that a plurality of needles are simultaneously positionable between said anvil shaft and said generally cylindrical members such that said needles are curvable around said anvil shaft, the longitudinal axis of said cylindrical members and said anvil shaft being in fixed parallel spatial relation;

at least one rotatable holding member for rotating said cylindrical members and said anvil shaft; and driving assembly for rotating said holding member, whereby said needleg are frictionally acceptable between said anvil shaft and a first cylinder, and are frictionally acceptable between said anvil shaft and a second cylinder while being curvable about said anvil shaft without substantially changing the cross-sectional shape of the needleg.

22. An apparatus according to claim 21, wherein said driving assembly comprises an elastomeric belt.

23. An apparatus according to claim 22, wherein said belt is rotatably positionable substantially about said cylindrical members and said anvil shaft.

24. An apparatus according to claim 21, wherein said anvil shaft is substantially elongated, and a multiplicity of needles are curvable around said substantially elongated anvil shaft.

25. An apparatus for curving needles which comprises:

a continuous belt having an inner surface and an outer surface;

a rotatable anvil shaft;

a first rotatable member and a second rotatable member, the rotatable members contacting the inner surface of the belt and pressing a portion of the outer surface of the belt against the anvil shaft, the longitudinal axis of said rotatable members and said anvil shaft being in fixed parallel spatial relation; and drive means for contacting the inner surface of the belt and moving the belt for gripping an end of a needle introduced between the outer surface of the belt and the anvil shaft and urging the needle into further contact with the belt and anvil shaft whereby a predetermined radius of curvature is imparted to the needle without substantially changing the cross-sectional shape of the needle.

26. An apparatus according to claim 25 wherein the belt comprises an elastomeric portion.

27. An apparatus according to claim 25 wherein the anvil shaft has a diameter between about 0.2 inches and about 0.5 inches.

28. An apparatus according to claim 25 wherein the longitudinal axes of the first and second rotatable members are positioned on opposite sides of a vertical plane passing through the longitudinal axis of the anvil shaft.

29. An apparatus according to claim 25 wherein the anvil shaft and the belt are configured and dimensioned to grip a plurality of needles simultaneously therebetween.

* * * * *